US006067663A

United States Patent [19]

Fernandez

[11] Patent Number: 6,067,663

[45] Date of Patent: May 30, 2000

[54] FEMININE GARMENT WITH SEXUALLY STIMULATING EFFECT

[76] Inventor: Luis Alvarez Fernandez, I.R. Solos 6., 33430 Candas (Carreño) - Oviedo, Spain

[21] Appl. No.: 09/051,549

[22] PCT Filed: Aug. 12, 1996

[86] PCT No.: PCT/ES96/00159

§ 371 Date: Mar. 22, 1999

§ 102(e) Date: Mar. 22, 1999

[87] PCT Pub. No.: WO98/06372

PCT Pub. Date: Feb. 19, 1998

[51] Int. Cl.[7] ..... A41B 9/04; A41D 5/00

[52] U.S. Cl. ..... 2/406; 2/400; 2/67

[58] Field of Search ..... 450/95, 97, 100, 450/101, 106, 112; 63/3; 601/84, 97, 99, 112, 113, 116–118, 124, 132, 134, 143; D2/700, 701, 711, 712, 731, 734, 738, 625, 631; 2/400–408, 67, 69, 311, 312, 336, 338, 313–319

[56] References Cited

U.S. PATENT DOCUMENTS

| | | | |
|---|---|---|---|
| D. 237,423 | 11/1975 | Gulack | D2/700 |
| D. 278,473 | 4/1985 | Briggery-Myles | D2/700 |
| D. 298,459 | 11/1988 | McCormick | 2/406 X |
| 4,121,305 | 10/1978 | Kolker | 2/406 |
| 4,394,781 | 7/1983 | Axmann | 2/67 |
| 4,905,323 | 3/1990 | Lampman . | |
| 5,086,519 | 2/1992 | Rokasky . | |
| 5,143,092 | 9/1992 | Flowers | 2/406 X |
| 5,212,839 | 5/1993 | Sliman et al. | 2/408 |
| 5,367,715 | 11/1994 | Leonard et al. | 2/401 |
| 5,368,050 | 11/1994 | Donelan | 2/406 X |
| 5,383,841 | 1/1995 | Lilley . | |
| 5,467,482 | 11/1995 | Crawford, II | 2/67 |
| 5,902,170 | 5/1999 | Ganz | 450/100 |

FOREIGN PATENT DOCUMENTS

WO 95/26175 10/1995 WIPO .

*Primary Examiner*—Gloria M. Hale
*Attorney, Agent, or Firm*—Marshall, O'Toole, Gerstein, Murray & Borun

[57] ABSTRACT

Feminine garment with sexual stimulation effect characterized in that it is worn on the waist, buttocks and pubis of a woman, including a piece that surrounds the waist, provided with a ring at a front central part to which is joined or attached the front extremity of a perineal necklace having one or more rows of beads passing over the pubis between the legs and buttocks of a woman, the rear extremity being linked to the center of the rear part of the woman's back. The walking motion or the movement of the legs causes a friction on the external genital parts, thereby producing sexual stimulation on the wearer. The garment is intended to provide sexual, ludic or erotic therapy.

19 Claims, 1 Drawing Sheet

FEMININE GARMENT WITH SEXUALLY STIMULATING EFFECT

FIELD OF THE INVENTION

Feminine garment, fitted with genital massaging devices

DESCRIPTION OF THE RELATED ART

Various feminine lingerie garments are known, the patents of which are essentially characterized by the type of textile materials used or by the effect of adherence to the body, compression or comfort of use derived from the shape of the garment, included in Class A 41 B 9/00 of the International Classification. Some of these feminine garments serve to produce a visually erotic stimulation in the male partner, but do not produce themselves an physical erogenous stimulation in the female wearer of the garment.

Devices are also known to provide massaging of the genital organs with therapeutic, playful or erogenous purposes, but these are preponderantly items for male use, which do not form part of the garment itself, included in Class A 61 H 19/00 of the International Classification.

However, there is no background on a garment worn over the waist, buttocks or groin of the female, which upon attachment on the front or rear of the garment by a string of beads, is capable of producing an erogenous massaging effect on the external genitalia of the female for the purpose of sexual therapy or for erotic or playful purposes.

SUMMARY OF THE INVENTION

The invention consists of a feminine garment worn over the waist, buttocks and groin of the female user, characterized by joining the front section and the rear section of the garment between the legs by attaching a perineal string formed by a lace with knots, a string with thick links or a string of spherical beads fitted with one or more threads: the knots, links or beads are made of or covered with metal, mother of pearl or some other material of appropriate hardness with suitable hygienic properties and which are easy to clean, the perineal string being worn as it hangs in the front of the garment after securing the ends of the garment with a front buckle, clasp or fastening means, allowing adjustment over the body and which, in addition to covering the groin and anal zone and extending over the external female genitalia, perineum and anal cleft, produces a rubbing action on the outer and inner labia and on the clitoris, as a result of walking or leg movement, thereby causing sexual stimulation in the wearer and consequent stimulation of her partner, the lingerie item also performing sexually therapeutic, playful or erotic aims.

The said garment, characterized by the fact that it is worn over the waist, buttocks and groin of the female user and by the fact that a string of spherical beads of a material having an appropriate hardness is in contact with the groin between the legs, between the front and rear sections of the garment, which may consist of a belt, fitted with said string (FIG. 1), of a thong or panty made of textile material, the front and rear sections of which are connected by the said string (FIG. 2), an elastic girdle for compressing the abdomen, fitted with said string (FIG. 3), a lingerie panty that replaces the groin-covering textile part by said string of beads between the legs or of a garment called "body", sweater or pajama made of any fabric that covers the abdomen and is fitted with a string or chain of beads connecting the front and rear sections of the garment and serving to produce the previously described sexual stimulation effect.

DETAILED DESCRIPTION OF THE PREFERRED EMBODIMENTS

Various forms of embodiment of this invention are specified hereunder as foreseen by the Applicant.

EXAMPLE 1

Figure 1:
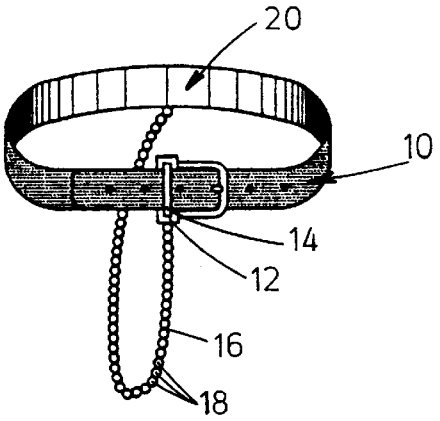
FIG. 1 is a perspective view illustrating a first embodiment of the invention.

A belt 10 (FIG. 1) made of leather, fabric or some other suitable material, fitted with a ring 12 attached to the front clasp 14, which secures the end of a strong string or chain 16 carrying separate spherical beads 18, each having a longitudinal orifice along its axis through which the string or chain 16 passes, and another ring (not shown) at the center of the rear section 20 of the belt, being provided for attaching the other end of the string or chain 16, of a length according to garment size and designed to exert pressure between the genital labia and the buttocks of the woman, to thereby cause friction upon walking or movement of the legs, resulting in consequent sexual stimulation. The string of beads 18 may be detachably secured by knotting onto the front end ring 12 hanging from the clasp 14, in such a way as to enable the user to adjust the pressure exerted by the string, while the fastening may provide a decorative effect.

EXAMPLE 2

Figure 2:
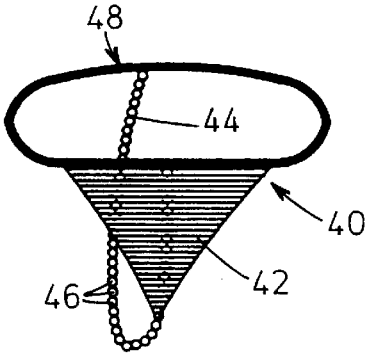
FIG. 2 is a perspective view illustrating a second embodiment of the invention.

A bathing suit or thong 40 (FIG. 2) made of textile material wherein the front triangular fabric portion 42 positioned over the groin and between the legs of the wearer is attached through a string 44 of spherical beads 46 extending between the buttocks to the rear part 48 of the garment which surrounds the waist, with the same purpose of sexual stimulation as in the previous Example.

EXAMPLE 3

Figure 3:
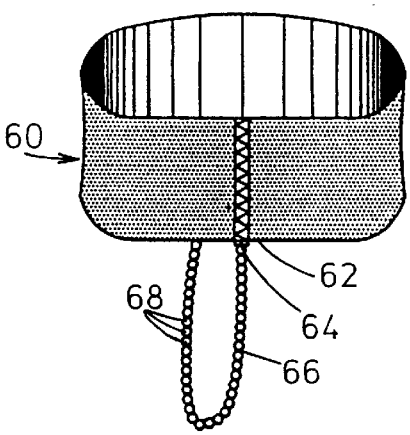
FIG. 3 is a perspective view illustrating a third embodiment of the invention.

An abdominal compression girdle 60 (FIG. 3) made of elastic material and provided at the front lower edge 62 at the height of the groin with a ring 44 into which a string 66 of spherical beads 68 is inserted, the other end of the string being secured to a similar ring (not shown) arranged on the rear lower edge of the garment on the buttocks, for the said purpose of sexually stimulating the female wearer by friction caused from walking or from the movement of the legs.

EXAMPLE 4

A panty or lingerie underwear which, in similar fashion to the bathing suit or thong in Example 2, attaches the front textile portion covering the groin between the legs to a rear textile portion covering the buttocks by means of a string or chain of spherical beads made of a hard material capable of causing friction on the external genitalia and between the buttocks to thus stimulate the wearer sexually.

EXAMPLE 5

A body stocking, sweater or pajama-type garment, which covers the abdomen, the front and rear parts of the garment being connected over the groin, genitals and buttocks with the same perineal string of beads to provide the said sexually stimulating effect.

INDUSTRIAL APPLICABILITY

The patent proposal is suitable for industrial exploitation in the clothing industry.

What is claimed is:

1. A female garment for providing a sexually stimulating effect to be worn over a waist, buttocks and groin of a female user, the garment comprising:

a band for surrounding the waist;

a front fastener positioned at a front center portion of the band;

a rear fastener attached to a rear center portion of the band;

a perineal string including a plurality of generally spherical bodies connected to a flexible carrier, the flexible carrier having a first end attached to the front fastener and a second end attached to the rear fastener, each spherical body having a substantially rigid outer surface;

wherein the spherical bodies extend from the pubis area to the anal zone and over the external female genitalia to provide friction or exert pressure over the external and internal labia and clitoris, caused or enhanced by leg movement of the female user, thus producing sexual stimulation of the female user.

2. The female garment of claim 1 in which the front and rear fasteners comprise hooks.

3. The female garment of claim 1 in which the front and rear fasteners comprise rings.

4. The female garment of claim 1, in which the front fastener is adapted to engage any point along the perineal string, thereby allowing the garment to be adjusted according to size or degree of pressure desired by the female user.

5. The female garment of claim 1, in which the flexible carrier comprises a string.

6. The female garment of claim 1, in which the flexible carrier comprises a chain.

7. The female garment of claim 1, in which the flexible carrier comprises a strand.

8. The female garment of claim 1, in which the spherical bodies comprise a plurality of beads, and the flexible carrier passes through an axis of each bead.

9. The female garment of claim 8, in which the outer surface of each bead comprises metal.

10. The female garment of claim 8, in which the outer surface of each bead comprises mother of pearl.

11. The female garment of claim 1, in which the spherical bodies comprise a plurality of knots formed in the flexible carrier.

12. The female garment of claim 1, further comprising means for fastening the band about the waist to form an elastic belt, and in which the front fastener is attached to the fastening means.

13. The female garment of claim 1, further comprising a front triangular textile part having a top edge portion attached to the front center portion of the band and a lower angle portion attached to the perineal string.

14. The female garment of claim 13, further comprising a rear triangular textile part having a top edge portion attached to the rear center portion of the band and a lower angle portion attached to the perineal string.

15. The female garment of claim 1, in which the band comprises an abdomen-compressing girdle.

16. A female garment for providing a sexually stimulating effect to be worn over an abdomen, waist, buttocks and groin of a female user, the garment comprising:

an article of clothing for surrounding at least the waist and abdomen of the female user;

a front fastener positioned at a front center portion of the article of clothing, a rear fastener attached to a rear center portion of the article of clothing, a perineal string including a plurality of spherical bodies connected to a flexible carrier, the flexible carrier having a first end attached to the front fastener and a second end attached to the rear fastener, each spherical body having a substantially rigid outer surface;

wherein the spherical bodies extend from the pubis area to the anal zone and over the external female genitalia to provide friction or exert pressure over the external and internal labia and clitoris, caused or enhanced by leg movement of the female user, thus producing sexual stimulation of the female user.

17. The female garment of claim 16, in which the article of clothing comprises a body stocking.

18. The female garment of claim 16, in which the article of clothing comprises a pajama.

19. The female garment of claim 16, in which the article of clothing comprises lingerie underwear.

* * * * *